US007196665B2

(12) United States Patent
Koshi et al.

(10) Patent No.: US 7,196,665 B2
(45) Date of Patent: Mar. 27, 2007

(54) ANTENNA DEVICE

(75) Inventors: Kazumine Koshi, Tsuyama (JP); Hideto Sadamori, Okayama (JP); Kazuto Kume, Moriguchi (JP)

(73) Assignee: Matsushita Electric Industrial Co., Ltd., Osaka (JP)

( * ) Notice: Subject to any disclaimer, the term of this patent is extended or adjusted under 35 U.S.C. 154(b) by 0 days.

(21) Appl. No.: 11/109,989

(22) Filed: Apr. 20, 2005

(65) Prior Publication Data

US 2005/0237245 A1 Oct. 27, 2005

(30) Foreign Application Priority Data

Apr. 21, 2004 (JP) ..... 2004-125208

(51) Int. Cl.
*H01Q 1/38* (2006.01)

(52) U.S. Cl. ..... 343/700 MS; 343/702

(58) Field of Classification Search ..... 343/700 MS, 343/702

See application file for complete search history.

(56) References Cited

U.S. PATENT DOCUMENTS 5,926,139 A 7/1999 Korisch
6,573,867 B1 * 6/2003 Desclos et al. ..... 343/700 MS
6,734,825 B1 * 5/2004 Guo et al. ..... 343/700 MS
6,933,902 B2 * 8/2005 Yeh ..... 343/762
2004/0104853 A1 * 6/2004 Chen ..... 343/702
2004/0222923 A1 * 11/2004 Erkocevic ..... 343/700 MS
2004/0233109 A1 * 11/2004 Ying et al. ..... 343/700 MS

OTHER PUBLICATIONS

"New Antenna Engineering—Antenna technology in era of mobile communications", by Hiroyuki Arai, Sogo Electronics Press, Apr. 9, 1996, pp. 109-114, Apr. 9, 1996, with partial English translation.

* cited by examiner

*Primary Examiner*—Trinh Vo Dinh
(74) *Attorney, Agent, or Firm*—RatnerPrestia

(57) ABSTRACT

An antenna device has a first antenna element supporting a low frequency band and a second antenna element supporting a high frequency band. The first antenna element and the second antenna element are disposed so as to face to each other, on the wiring board of a radio device, and at positions separated from each other by a predetermined distance. The distance between the first antenna element and the ground of wiring board is longer than the distance between the second antenna element and the ground of the wiring board. The antenna device supports two frequency bands with the first antenna element and the second antenna element.

3 Claims, 3 Drawing Sheets

ANTENNA DEVICE

FIELD OF THE INVENTION

The present invention relates to a multi-band-compatible antenna device for use mainly in a radio device for mobile communications.

BACKGROUND OF THE INVENTION

Recently, demand for a radio device for mobile communications sharply increases, variety of the form of the radio device increases, and transmission and receiving of more information by one radio device is required. A radio device capable of transmitting and receiving radio waves in a plurality of frequency bands is sold, and the radio device employs a multi-band-compatible antenna device available in a plurality of frequency bands.

A portable phone is described as a radio device for mobile communications employing such an antenna device.

Portable phones are used in various areas in the world, and a different frequency band is employed in each area. In a digital portable phone, for example, the frequency band of a global system for mobile communications (GSM) is 880 to 960 MHz, that of a digital communication system (DCS) is 1710 to 1880 MHz, and that of a personal communication system (PCS) is 1850 to 1990 MHz.

As the portable phone is downsized and made compact and the number of bands increases, the number of antenna devices built and used in the portable phones is apt to increase and the demand for downsizing the antenna devices grows.

As a conventional multi-band-compatible antenna device built in the portable phone, a plate inverted-F antenna shown in FIG. 3 is described.

FIG. 3 is a perspective view of a conventional plate inverted-F antenna supporting two frequency bands, GSM and DCS. In FIG. 3, first antenna element 21 is an antenna supporting GSM, and second antenna element 22 is an antenna supporting DCS. These plate inverted-F antennas are mounted on wiring board 23 of a portable phone (not shown). Second antenna element 22 may support PCS.

In the plate inverted-F antenna, first antenna element 21 supporting low frequencies and second antenna element 22 supporting high frequencies face wiring board 23 in parallel, and are disposed on the same plane side by side. Desired element width, length, and inter-element distance are set for first antenna element 21 and second antenna element 22 so as to provide respective required radiant efficiencies.

One end of first antenna element 21 and one end of second antenna element 22 are integrally interconnected, and are connected to the ground (GND) terminal (not shown) and feeding point (not shown) of wiring board 23, respectively. They are mounted in the portable phone.

As document information of the conventional art related to the present invention, U.S. Pat. No. 5,926,139 and "New antenna engineering", by Hiroyuki Arai, Sogo Electronics Press, Apr. 9, 1996, p109–p 114 are known, for example.

In the conventional antenna device, however, radiant efficiency of each antenna element must be increased in order to prevent the band width having desired sensitivity in a frequency band used in the portable phone, namely a so called specific band, from becoming narrow. The radiant efficiencies can be increased when shape sizes of first antenna element 21 and second antenna element 22 are increased to enlarge projection area. However, this method goes against the recent demand for downsizing a radio device. In this conventional configuration, however, it is difficult to provide a built-in type multi-band-compatible antenna device that is downsized and has high radiant efficiency.

The present invention addresses such a conventional problem, and provides a built-in type antenna device that can easily support many bands, can be downsized, and has antenna elements having balanced radiant efficiency.

SUMMARY OF THE INVENTION

For accomplishing the purpose, an antenna device of the present invention has the following configuration, in which

- the antenna device has a first antenna element supporting a low frequency band and a second antenna element supporting a high frequency band,
- the first antenna element and second antenna element are disposed so as to face each other, on a wiring board of a radio device, and at positions separated from each other by a predetermined distance,
- the distance between first antenna element and the ground of the wiring board is longer than that between the second antenna element and the ground of the wiring board, and
- the antenna device supports two frequency bands with the first antenna element and second antenna element.

Therefore, the effect from the GND on the wiring board depends on the frequency supported by each antenna element, but the layout discussed above allows reduction of the effect. Radiant efficiencies of respective antenna elements can be therefore brought into good balance. The antenna elements are disposed vertically, so that the whole antenna device can be downsized. As a result, a small antenna device having high radiant efficiency can be realized.

In the configuration discussed above, the first antenna element may support a GSM and the second antenna element may support a DCS or a PCS in a portable phone.

In the configuration discussed above, the distance between the first antenna element and the second antenna element may be set substantially equal to that between the second antenna element and the ground of the wiring board.

In such configuration, effects from the GND on respective frequency bands supported by the first antenna element and the second antenna element can be reduced, and a layout having good balance between radiant efficiencies can be provided. The whole antenna device can be also downsized.

In the configuration discussed above, the facing region between the first antenna element and the second antenna element may be an empty space, and distance $D_1$ between the first antenna element and the GND of the wiring board and distance $D_2$ between the second antenna element and the GND may be set in the range expressed by $D_2/D_1=\lambda_{LMIN}/\lambda_{HMAX}$ to $\lambda_{LMAX}/\lambda_{HMIN}$. Here, $\lambda_{LMAX}$ and $\lambda_{LMIN}$ are a wavelength of the radio wave corresponding to the maximum frequency of the low frequency band and a wavelength of the radio wave corresponding to the minimum frequency thereof, respectively, and $\lambda_{HMAX}$ and $\lambda_{HMIN}$ are a wavelength of the radio wave corresponding to the maximum frequency of the high frequency band and a wavelength of the radio wave corresponding to the minimum frequency thereof, respectively.

In the configuration discussed above, the facing region between the first antenna element and the second antenna element may be an empty space, and distance $D_1$ between the first antenna element and the GND of the wiring board and distance $D_2$ between the second antenna element and the GND may be set to satisfy expression $D_2/D_1=\lambda_{LMID}/\lambda_{HMID}$.

Here, $\lambda_{LMID}$ is a wavelength of the radio wave corresponding to the center frequency of the low frequency band, and $\lambda_{HMID}$ is a wavelength of the radio wave corresponding to the center frequency of the high frequency band.

In such configuration, effects from the GND on respective frequency bands supported by the first antenna element and the second antenna element can be reduced, and a layout having good balance between radiant efficiencies can be provided. The whole antenna device can be also downsized.

In the configuration discussed above, the following conditions may be established:

- the facing region between the first antenna element and the second antenna element is an empty space;
- distance $D_1$ between the first antenna element and the GND of the wiring board and distance $D_2$ between the second antenna element and the GND when the facing region between the first antenna element and the second antenna element is an empty space are set in the range expressed by $D_2/D_1=\lambda_{LMIN}/\lambda_{HMAX}$ to $\lambda_{LMAX}/\lambda_{HMIN}$, where, $\lambda_{LMAX}$ and $\lambda_{LMIN}$ are a wavelength of the radio wave corresponding to the maximum frequency of the low frequency band and a wavelength of the radio wave corresponding to the minimum frequency thereof, respectively, and $\lambda_{HMAX}$ and $\lambda_{HMIN}$ are a wavelength of the radio wave corresponding to the maximum frequency of the high frequency band and a wavelength of the radio wave corresponding to the minimum frequency thereof, respectively; and
- distance $D_3$ between the first antenna element and the second antenna element when the facing region between the first antenna element and the second antenna element is filled with an insulator is set to satisfy $D_3=(D_1-D_2)/\sqrt{\in*\mu}$, where $\in$ and $\mu$ are dielectric constant and magnetic permeability of the insulator, respectively.

In this configuration, positional relationship of the first antenna element and the second antenna element can be specified when the region between them is filled with the insulator. When the region between the first antenna element and the second antenna element is filled with the insulator and the antenna elements are mutually fixed and supported, the antenna elements are simply required to be arranged based on the expressions discussed above. Thus, each effect from the GND is reduced, and an optimal layout state having good balance between radiant efficiencies can be provided. The projection area can be reduced and the whole shape can be downsized.

In the present invention, the second antenna element supporting the high frequency band is disposed between the first antenna element supporting the low frequency band and the GND of the wiring board so as to reduce the effect from the GND on each antenna element. Thus, the projection area can be reduced, and a built-in type antenna device that is downsized and has high radiant efficiency can be provided.

DETAILED DESCRIPTION OF THE INVENTION

Figure 1:
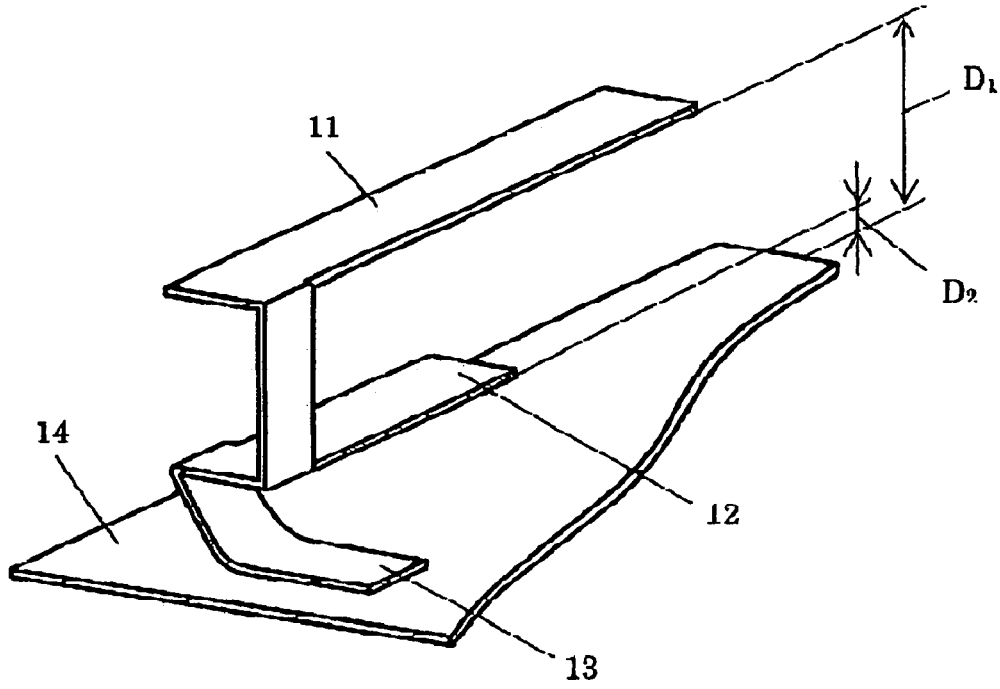
FIG. 1 is an outline view of an antenna device in accordance with an exemplary embodiment of the present invention.

An antenna device in accordance with an exemplary embodiment of the present invention will be described hereinafter with reference to the drawings. Same elements are denoted with the same reference numbers in the drawings, and the descriptions of those elements are omitted.

FIG. 1 is a perspective view of an antenna device in accordance with the exemplary embodiment. The antenna device has a so-called folded monopole type configuration including two antenna elements. The antenna device can support two frequency bands, namely GSM frequency band 880–960 MHz and DCS frequency band 1710–1880 MHz, or GSM frequency band 880–960 MHz and PCS frequency band 1850–1990 MHz. In other words, the antenna device is a so-called multi-band-compatible antenna device. The antenna device is of a built-in type, namely is built in a radio device.

The configuration of the antenna device of the present embodiment is described with reference to FIG. 1. First antenna element 11 is made of conductive metal such as a copper alloy sheet. First antenna element 11 supports the GSM having a low frequency band. Second antenna element 12 is also made of conductive metal such as a copper alloy sheet. Second antenna element 12 supports the DCS (or PCS) having a high frequency band. Feeding point 13 is connected to wiring board 14 of a used radio device.

One end of first antenna element 11 and one end of second antenna element 12 are interconnected and integrated, and feeding point 13 is folded from the integrated region as shown in FIG. 1. Second antenna element 12 supporting the DCS (or PCS) is disposed between first antenna element 11 supporting the GSM and the GND of wiring board 14. First antenna element 11, second antenna element 12, and wiring board 14 are arranged substantially in parallel.

First antenna element 11 and second antenna element 12 are disposed vertically so that the distance between the GND of wiring board 14 and second antenna element 12 is substantially equal to the distance between second antenna element 12 and first antenna element 11.

In other words, distance $D_1$ between first antenna element 11 and the GND of wiring board 14 and distance $D_2$ between second antenna element 12 and the GND are set to satisfy $D_2/D_1=\lambda_{LMID}/\lambda_{HMID}$. Here, $\lambda_{LMID}$ is a wavelength of the radio wave corresponding to the center frequency of the low frequency band, and $\lambda_{HMID}$ is a wavelength of the radio wave corresponding to the center frequency of the high frequency band.

A specific example is described hereinafter. The wavelength of the radio wave is expressed by $\lambda=c/f$ ($\lambda$: wavelength, c: velocity of light, and f: frequency). As the example, an antenna device supporting two frequencies, namely the DCS having a high frequency band and the GSM having a low frequency band is taken.

Center frequency $f_D$ of the DCS having the high frequency band is expressed by $f_D=(1710+1880)/2=1795$ MHz. Center frequency $f_G$ of the GSM having the low frequency band is expressed by $f_G=(880+960)/2=920$ MHz. The ratio between wavelength $\lambda_{HMID}$ of the radio wave corresponding to the center frequency of the DCS and wavelength $\lambda_{LMID}$ of the radio wave corresponding to the center frequency of the GSM is expressed by $\lambda_{HMID}/\lambda_{LMID}=0.51$.

When the ratio between distance $D_1$ between the GND and first antenna element 11 and distance $D_2$ between the GND and second antenna element 12 is expressed by $D_2/D_1=0.51$, first antenna element 11 supporting the GSM and second antenna element 12 supporting the DCS can have the same level of radiation characteristic.

In an antenna device supporting two frequencies of the GSM having the low frequency band and the PCS having the high frequency band, the following setting is performed. Center frequency $f_P$ of the PCS having the high frequency band is expressed by $f_P=(1850+1990)/2=1920$ MHz. The ratio between wavelength $\lambda_{HMID}$ of the radio wave corresponding to the center frequency of the PCS and wavelength $\lambda_{LMID}$ of the radio wave corresponding to the center of the GSM is expressed by $\lambda_{HMID}/\lambda_{LMID}=0.48$. Thus, when the ratio between distance $D_1$ between the GND and first antenna element 11 and distance $D_2$ between the GND and second antenna element 12 is set as $D_2/D_1=0.48$, first antenna element 11 supporting the GSM and second antenna element 12 supporting the PCS can have the same level of radiation characteristic.

Based on the results, in the antenna device of the present embodiment, distance $D_2$ between the GND and second antenna element 12 for the DCS (or PCS) and the distance between second antenna element 12 for the DCS (or PCS) and first antenna element 11 for the GSM are set to be substantially equal to each other.

These distances are set based on center frequencies in the discussion above; however, the distances may be set in the following ranges in the present invention.

In other words, distance $D_1$ between first antenna element 11 and the ground of wiring board 14 and distance $D_2$ between second antenna element 12 and the ground are set in the range expressed by $D_2/D_1=\lambda_{LMIN}/\lambda_{HMAX}$ to $\lambda_{LMAX}/\lambda_{HMIN}$. Here, $\lambda_{LMAX}$ and $\lambda_{LMIN}$ are a wavelength of the radio wave corresponding to the maximum frequency of the low frequency band and a wavelength of the radio wave corresponding to the minimum frequency thereof, respectively, and $\lambda_{HMAX}$ and $\lambda_{HMIN}$ are a wavelength of the radio wave corresponding to the maximum frequency of the high frequency band and a wavelength of the radio wave corresponding to the minimum frequency thereof, respectively.

Setting the distances in the range allows first antenna element 11 supporting the low frequency band and second antenna element 12 supporting the high frequency band to have the same level of radiation characteristic.

A specific example is described hereinafter. As the example, similarly to the above-mentioned example, an antenna device supporting two frequencies in the DCS having a high frequency band and the GSM having a low frequency band is taken.

The frequency band of the DCS is 1710 to 1880 MHz, and the frequency band of the GSM is 880 to 960 MHz. Therefore, the minimum frequency of the GSM frequency band, namely the low frequency band, is 880 MHz. The maximum frequency of the DCS frequency band, namely the high frequency band, is 1880 MHz. Therefore, the ratio between wavelength $\lambda_{HMAX}$ of the radio wave corresponding to the maximum frequency of the DCS and wavelength $\lambda_{LMIN}$ of the radio wave corresponding to the minimum frequency of the GSM is expressed by $\lambda_{HMAX}/\lambda_{LMIN}=0.56$.

The maximum frequency of the GSM frequency band, namely the low frequency band, is 960 MHz. The minimum frequency of the DCS frequency band, namely the high frequency band, is 1710 MHz. Therefore, the ratio between wavelength $\lambda_{HMIN}$ of the radio wave corresponding to the minimum frequency of the DCS and wavelength $\lambda_{LMAX}$ of the radio wave corresponding to the maximum frequency of the GSM is expressed by $\lambda_{HMIN}/\lambda_{LMAX}=0.47$.

Thus, when the ratio between distance $D_1$ between the GND and first antenna element 11 and distance $D_2$ between the GND and second antenna element 12 is set in the range $D_2/D_1=0.47$ to 0.56, first antenna element 11 supporting the GSM and second antenna element 12 supporting the DCS can have the same level of radiation characteristic.

A similar setting is performed also in an antenna device supporting two frequencies in the PCS having a high frequency band and the GSM having a low frequency band. The frequency band of the PCS is 1850 to 1990 MHz, and the frequency band of the GSM is 880 to 960 MHz. Therefore, the minimum frequency of the GSM frequency band, namely the low frequency band, is 880 MHz. The maximum frequency of the PCS frequency band, namely the high frequency band, is 1990 MHz. Therefore, the ratio between wavelength $\lambda_{HMAX}$ of the radio wave corresponding to the maximum frequency of the PCS and wavelength $\lambda_{LMIN}$ of the radio wave corresponding to the minimum frequency of the GSM is expressed by $\lambda_{HMAX}/\lambda_{LMIN}=0.44$.

The maximum frequency of the GSM frequency band, namely the low frequency band, is 960 MHz. The minimum frequency of the PCS frequency band, namely the high frequency band, is 1990 MHz. Therefore, the ratio between wavelength $\lambda_{HMIN}$ of the radio wave corresponding to the minimum frequency of the PCS and wavelength $\lambda_{LMAX}$ of the radio wave corresponding to the maximum frequency of the GSM is expressed by $\lambda_{HMIN}/\lambda_{LMAX}=0.52$.

Thus, when the ratio between distance $D_1$ between the GND and first antenna element 11 and distance $D_2$ between the GND and second antenna element 12 is set in the range $D_2/D_1=0.44$ to 0.52, first antenna element 11 supporting the GSM and second antenna element 12 supporting the DCS can have the same level of radiation characteristic.

Setting the distances in the range allows an antenna device capable of supporting many bands of the GSM and DCS or the GSM and PCS to be provided.

In the antenna device of the present embodiment, effects from the GND on first antenna element 11 supporting to GSM having the low frequency band and second antenna element 12 supporting to DCS (or PCS) having the high frequency band are reduced, and the radiant efficiencies thereof can be brought into good balance.

In the antenna device of the present embodiment, first antenna element 11 and second antenna element 12 are disposed vertically, so that the projection area can be reduced and the outer shape can be downsized.

Figure 2:
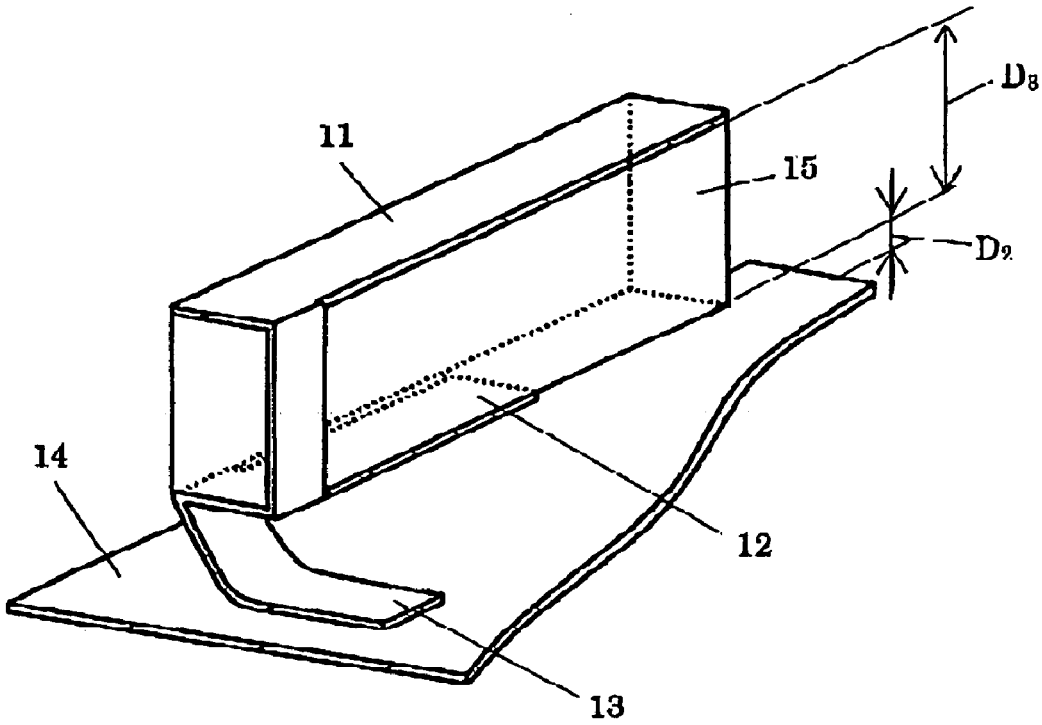
FIG. 2 is a perspective view of a configuration where the region between a first antenna element and a second antenna element is filled with an insulator in another antenna device in accordance with the exemplary embodiment.
Figure 3:
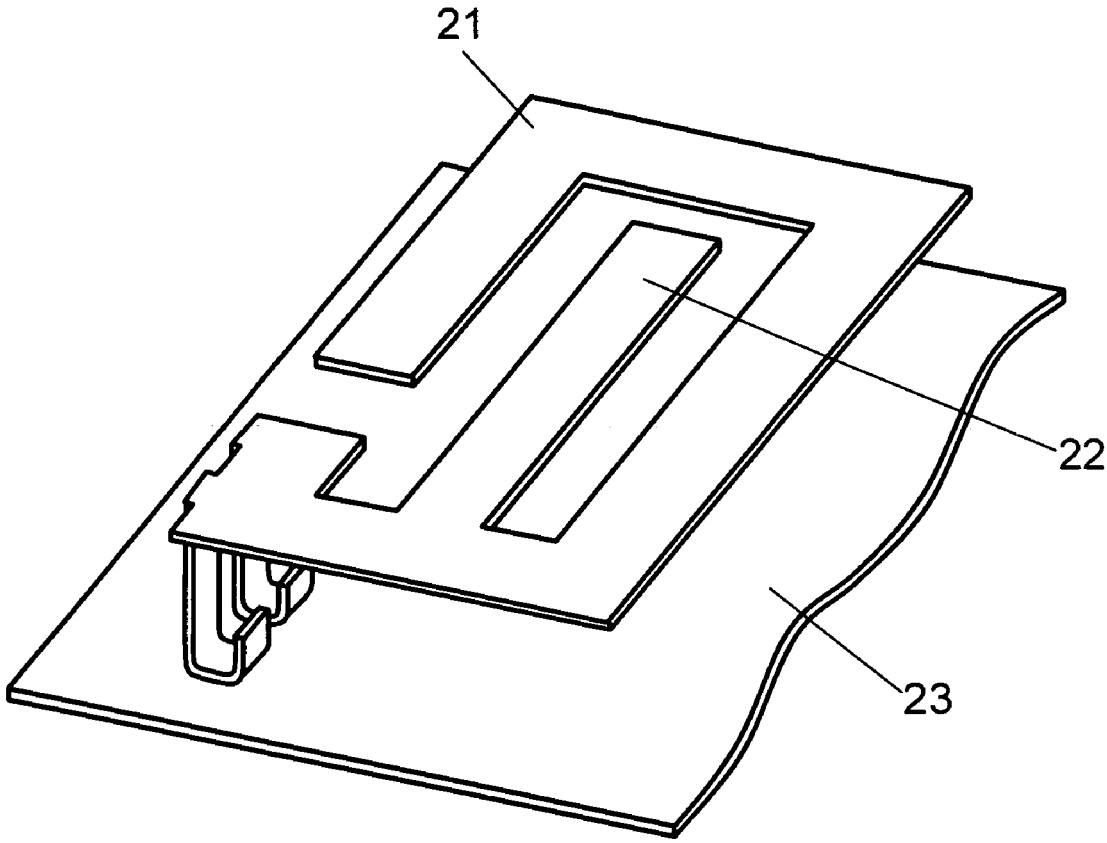
FIG. 3 PRIOR ART
FIG. 3 is an outline view of a conventional plate inverted-F antenna.

The antenna device where the space between antenna elements is empty has been described. FIG. 2 is a perspective view of a configuration where the space between a first antenna element and a second antenna element is filled with an insulator in another antenna device in accordance with the present embodiment. As shown in FIG. 2, first antenna element 11 and second antenna element 12 are fixed to each other through insulator 15 such as insulating resin.

In this case, distance $D_1$ between first antenna element 11 and the GND of wiring board 14 and distance $D_2$ between second antenna element 12 and the GND when the facing region between first antenna element 11 and second antenna element 12 is an empty space are set to satisfy $D_2/D_1=\lambda_{LMID}/\lambda_{HMID}$. Here, $\lambda_{LMID}$ is a wavelength of the radio wave corresponding to the center frequency of the low frequency band, and $\lambda_{HMID}$ is a wavelength of the radio wave corresponding to the center frequency of the high frequency band. Distance $D_3$ between first antenna element 11 and second antenna element 12 when the facing region between first antenna element 11 and second antenna element 12 is filled with insulator 15 is set to satisfy $D_3=(D_1-D_2)/\sqrt{\in*\mu}$, where $\in$ and $\mu$ are dielectric constant and magnetic permeability of insulator 15, respectively.

A specific example is described hereinafter.

$D_1$ and $D_2$ are firstly determined as discussed above when insulator 15 is not filled, namely when the region between the antenna elements is the empty space. The expression $\sqrt{\in^*\mu}=1/c$ ($\in$: dielectric constant of insulator, $\mu$: magnetic permeability of insulator, and c: velocity of light) is satisfied in the region filled with insulator 15. Therefore, distance $D_3$ between first antenna element 11 supporting the GSM and second antenna element 12 supporting the DCS (or PCS) is simply required to be set at $D_3=(D_1-D_2)/\sqrt{\in^*\mu}$. Here, the region between the elements is filled with insulator 15.

When each antenna element is fixed and supported by the insulator, arranging the antenna elements based on the expressions discussed above allows the effect from the GND on each antenna element to be reduced, the radiant efficiencies to be brought into good balance, the projection area to be reduced, and the whole shape to be downsized.

These distances are set based on the center frequencies in the discussion above; however, the distances may be set in the following ranges in the present invention.

In other words, distance $D_1$ between first antenna element 11 and the ground of wiring board 14 and distance $D_2$ between second antenna element 12 and the ground when the space between first antenna element 11 and second antenna element 12 is empty are set to satisfy $D_2/D_1=\lambda_{LMIN}/\lambda_{HMAX}$ to $\lambda_{LMAX}/\lambda_{HMIN}$. Here, $\lambda_{LMAX}$ and $\lambda_{LMIN}$ are a wavelength of the radio wave corresponding to the maximum frequency of the low frequency band and a wavelength of the radio wave corresponding to the minimum frequency thereof, respectively, and $\lambda_{HMAX}$ and $\lambda_{HMIN}$ are a wavelength of the radio wave corresponding to the maximum frequency of the high frequency band and a wavelength of the radio wave corresponding to the minimum frequency thereof, respectively. Distance $D_3$ between first antenna element 11 and second antenna element 12 when the facing region between first antenna element 11 and second antenna element 12 is filled with insulator 15 is set to satisfy $D_3=(D_1-D_2)/\sqrt{\in^*\mu}$.

Setting the distances in such ranges allows first antenna element 11 supporting the low frequency band and second antenna element 12 supporting the high frequency band to have the same level of radiation characteristic.

When each antenna element is fixed and supported by the insulator, the antenna elements may be arranged based on the expressions discussed above.

As discussed above, the antenna device of the present invention has the configuration where second antenna element 12 supporting a high frequency band is disposed between first antenna element 11 supporting a low frequency band and the GND of wiring board 14.

This configuration can reduce the effect from the GND on each antenna element. An antenna device that has small projection area, is downsized, has good balance between the radiant efficiencies, is multi-band-compatible, and is of a built-in type is provided. This antenna device is useful for a radio device for mobile communications or the like.

What is claimed is:

1. An antenna device comprising:

a first antenna element transmitting and receiving a low frequency radio wave band;

a second antenna element transmitting and receiving a high frequency radio wave band, wherein, the first antenna element and the second antenna element are disposed so as to face each other, above a wiring board of a radio device, and a distance between the first antenna element and the ground of the wiring board is longer than a distance between the second antenna element and the ground of the wiring board, the antenna device transmits and receives two frequency radio wave bands with the first antenna element and the second antenna element, and the first antenna element supports GSM and the second antenna element supports one of DCS and PCS, and the antenna device is used for a portable phone, wherein, a distance between the first antenna element and the second antenna element is substantially equal to the distance between the second antenna element and the around of the wiring board, wherein, facing region between the first antenna element and the second antenna element is an empty space, and distance $D_1$ between the first antenna element and the ground of the wiring board and distance $D_2$ between the second antenna element and the ground are set in a range expressed by $D_2/D_1=\lambda_{LMIN}/\lambda_{HMAX}$ to $\lambda_{LMAX}/\lambda_{HMIN}$, where $\lambda_{LMAX}$ and $\lambda_{LMIN}$ are a wavelength of a radio wave corresponding to a maximum frequency of the low frequency band and a wavelength of a radio wave corresponding to a minimum frequency of the low frequency band, respectively, and $\lambda_{HMAX}$ and $\lambda_{HMIN}$ are a wavelength of a radio wave corresponding to a maximum frequency of the high frequency band and a wavelength of a radio wave corresponding to a minimum frequency of the high frequency band, respectively.

2. An antenna device comprising:

a first antenna element transmitting and receiving a low frequency radio wave a first antenna element transmitting and receiving a low frequency radio wave band;

a second antenna element transmitting and receiving a high frequency radio wave band, wherein, the first antenna element and the second antenna element are disposed so as to face each other, above a wiring board of a radio device, and a distance between the first antenna element and the ground of the wiring board is longer than a distance between the second antenna element and the ground of the wiring board, the antenna device transmits and receives two frequency radio wave bands with the first antenna element and the second antenna element, and the first antenna element supports GSM and the second antenna element supports one of DCS and PCS, and the antenna device is used for a portable phone, wherein, a distance between the first antenna element and the second antenna element is substantially equal to the distance between the second antenna element and the around of the wiring board, wherein, facing region between the first antenna element and the second antenna element is an empty space, and distance $D_1$ between the first antenna element and the ground of the wiring board and distance $D_2$ between the second antenna element and the ground are set to satisfy $D_2/D_1=\lambda_{LMID}/\lambda_{HMID}$, where $\lambda_{LMID}$ is a wavelength of a radio wave corresponding to a center frequency of the low frequency band, and $\lambda_{HMID}$ is a wavelength of a radio wave corresponding to a center frequency of the high frequency band.

3. An antenna device comprising:

a first antenna element transmitting and receiving a low frequency radio wave band;

a second antenna element transmitting and receiving a high frequency radio wave band, wherein, the first antenna element and the second antenna element are disposed so as to face each other, above a wiring board of a radio device, and a distance between the first antenna element and the ground of the wiring board is longer than a distance between the second antenna element and the ground of the wiring board, the antenna device transmits and receives two frequency radio wave bands with the first antenna element and the second antenna element, and the first antenna element supports GSM and the second antenna element supports one of DCS and PCS, and the antenna device is used for a portable phone, wherein, facing region between the first antenna element and the second antenna element is filled with an insulator, distance $D_1$ between the first antenna element and the ground of the wiring board and distance $D_2$ between the second antenna element and the ground when the facing region between the first antenna element and the second antenna element is an empty space are set in a range satisfying $D_2/D_1=\lambda_{LMIN}/\lambda_{HMAX}$ to $\lambda_{LMAX}/\lambda_{HMIN}$, where $\lambda_{LMAX}$ and $\lambda_{LMIN}$ are a wavelength of a radio wave corresponding to a maximum frequency of the low frequency band and a wavelength of a radio wave corresponding to a minimum frequency of the low frequency band, respectively, and $\lambda_{HMAX}$ and $\lambda_{HMIN}$ are a wavelength of a radio wave corresponding to a maximum frequency of the high frequency band and a wavelength of a radio wave corresponding to a minimum frequency of the high frequency band, respectively, and distance $D_3$ between the first antenna element and the second antenna element when the facing region between the first antenna element and the second antenna element is filled with the insulator is set to satisfy $D_3=(D_1-D_2)/\sqrt{\in^*\mu}$, where $\in$ and $\mu$ are dielectric constant and magnetic permeability of the insulator, respectively.

* * * * *

UNITED STATES PATENT AND TRADEMARK OFFICE

CERTIFICATE OF CORRECTION

PATENT NO. : 7,196,665 B2
APPLICATION NO. : 11/109989
DATED : March 27, 2007
INVENTOR(S) : Kazumine Koshi et al It is certified that error appears in the above-identified patent and that said Letters Patent is hereby corrected as shown below:

Column 8
Line 14, change "around" to -- ground --

Column 8
Line 15, after "wherein," add -- a --

Column 8
Line 33, after "wave" add -- band --

Column 8
Lines 34 and 35 delete
"a first antenna element transmitting and receiving a low frequency radio wave band;"

Column 8
Line 54, change "around" to -- ground --

Column 8
Line 55, after "wherein," add -- a --

Column 9
Line 16, after "wherein," add -- a --

Signed and Sealed this

Twenty-eighth Day of August, 2007

JON W. DUDAS
*Director of the United States Patent and Trademark Office*